US007766672B1

(12) United States Patent
Chiang

(10) Patent No.: US 7,766,672 B1
(45) Date of Patent: Aug. 3, 2010

(54) ELECTRONIC CONNECTOR WITH A CIRCUIT BOARD SANDWICHED BETWEEN TWO SPACERS AND ENCLOSED IN A FRAME

(75) Inventor: Cheng-Chang Chiang, Taipei (TW)

(73) Assignee: Cameo Communication, Inc. (TW)

( * ) Notice: Subject to any disclaimer, the term of this patent is extended or adjusted under 35 U.S.C. 154(b) by 0 days.

(21) Appl. No.: 12/456,962

(22) Filed: Jun. 24, 2009

(51) Int. Cl.
*H01R 12/00* (2006.01)

(52) U.S. Cl. ..... 439/76.1

(58) Field of Classification Search ..... 439/76.1, 439/76.2, 66, 526, 607.14, 607.24, 607.31, 439/607.33

See application file for complete search history.

(56) References Cited

U.S. PATENT DOCUMENTS 5,730,620 A * 3/1998 Chan et al. ..... 439/526
7,390,197 B2 * 6/2008 Merz ..... 439/76.1
7,446,544 B2 * 11/2008 Igarashi et al. ..... 324/754
2002/0098721 A1 * 7/2002 Fan et al. ..... 439/66
2009/0023313 A1 * 1/2009 Hayakawa ..... 439/76.2

* cited by examiner

*Primary Examiner*—Chandrika Prasad

(57) ABSTRACT

An electronic connector includes a circuit board, an upper spacer, a lower spacer, and a front frame. The circuit board having a front segment that is provided with contact pins is formed with at least one first positioning hole. The upper spacer and the lower spacer are coupled to the circuit board through the first positioning hole from above and below, respectively, so that the circuit board is sandwiched between the upper and lower spacers. The front frame has a through opening and is mounted around the front segment so that the front segment of the circuit board, the upper spacer, and the lower spacer are jointly received in the through opening of the front frame. Thereby, the upper and the lower spacers are positioned between the circuit board and the front frame for preventing electrical contact therebetween.

16 Claims, 4 Drawing Sheets

ELECTRONIC CONNECTOR WITH A CIRCUIT BOARD SANDWICHED BETWEEN TWO SPACERS AND ENCLOSED IN A FRAME

BACKGROUND OF INVENTION

1. Field of the Invention

The present invention relates to electronic connectors, and more particularly, to an electronic connector conforming to the USB (Universal Serial Bus) standard, wherein the electronic connector is advantageous for being economical and easy in manufacture and being compact in size.

2. Description of the Prior Art

With the rapid progress of information technology, market demands have shown explosive growth for various electronic information devices. To respond to such demands, diversified versatile electronic products and computer peripheries have been developed and do facilitate our daily life. Giving some examples, memory cards and card readers, flash disks, portable hard drives, digital cameras, MP3 players, and mice, keyboards as well as printers for use with computers, are those very popularly used. The electronic products and computer peripheries usually need to be connected with computer hosts for data transmission or exchange. To allow devices to work with computers of common specification, many transfer protocols have been defined and internationally accepted. Among others, the USB (Universal Serial Bus) and IEEE 1394 standards are extensively applied nowadays. While having their respective specifications and structures for connectors, the USB and IEEE 1394 standards realize compatibility among electronic devices for different functions and from different manufacturers.

For instance, a conventional USB connector 10, as shown in FIG. 1, primarily includes a connecting portion 11 and a circuit board 12. A plurality of contact pins 13 are provided in the connecting portion 11 while a control circuit 14 is formed on the circuit board 12. The connecting portion 11 with its positioning tenons 15 coupled with positioning holes 16 formed on the circuit board 12. Then the contact pins 13 are connected to the control circuit 14 by means of tin soldering. However, the conventional electronic connector 10 involves use of expensive components and is bulky. Beside, the SMT (Surface-Mount Technology) process, which is now commonly used for making the aforementioned electronic connector, also adds a heavy burden to the manufacturers' costs. Thus, the conventional connector needs to be improved.

SUMMARY OF INVENTION

One objective of the present invention is to provide a novel electronic connector, which is advantageous for being economical and easy in manufacture and being compact in size.

In order to achieve the aforesaid objective, the present invention discloses an electronic connector which comprises: a circuit board, an upper spacer, a lower spacer and a front frame. The circuit board has a front segment provided with a plurality of contact pins. There is at least one first positioning hole formed at a predetermined location on the circuit board. The upper spacer is positioned on the circuit board and is corresponding to the at least one first positioning hole. The lower spacer is coupled to the front segment of the circuit board from below, wherein at least one post is provided on the upper spacer or the lower spacer for corresponding to the first positioning hole so that when the post passes through the first positioning hole, the circuit board is sandwiched between the upper spacer and the lower spacer. The front frame has a through opening and is mounted around the front segment of the circuit board, so that the front segment, the upper spacer, and the lower spacer are such received in the through opening that the upper spacer and the lower spacer are positioned between the circuit board and the front frame, thereby preventing the front frame from electrically connecting with the front segment of the circuit board.

In one preferred embodiment, the upper spacer and the lower spacer are made of a non-conductive material, and the lower spacer comprises a front bar and two ribs extending from two ends of the front bar so that the lower spacer is generally of a C-shaped structure, wherein the at lest one post includes two posts provided on the ribs of the lower spacer, respectively, and the upper spacer has two countersinks corresponding to the two posts, so that the posts of the lower spacer passing through the first positioning holes are received in the two countersinks of the upper spacer.

In one preferred embodiment, the circuit board has at least one second positioning hole, and the lower spacer has at least one protuberance corresponding to the at least one second positioning hole, so that the protuberance is received in the second positioning hole.

In one preferred embodiment, the front bar abuts against a front edge of the front segment of the circuit board, and the front bar has a thickness greater than a thickness of each rib, wherein a difference between the thicknesses of the front bar and the ribs is generally equal to a thickness of the front segment of the circuit board, so that when the lower spacer is couple below the front segment of the circuit board, an upper surface of the front bar is generally level with an upper surface of the front segment of the circuit board.

In one preferred embodiment, at least one first notch is formed at one of two opposite lengthwise edges of the front segment of the circuit board and extending transversely inward while at least one retainer is formed on the front frame and corresponding to the first notch, so that the retainer engages with the first notch. The retainer is formed as an inward-bent part and is made by partially punching the front frame inward the through opening.

In one preferred embodiment, at least one second notch is formed at one of two opposite lengthwise edges of the circuit board at a predetermined location while at least one recess is formed on the front frame and corresponding to the second notch, wherein the recess has an opening direction perpendicular to an opening direction of the second notch, so that the recess and the second notch are crisscross coupled.

In one preferred embodiment, two depressed portions are formed as two inward-bent parts by partially punching the front frame inward the through opening, and the two depressed portions abut against two opposite lengthwise edges of the front segment of the circuit board at predetermined locations.

In one preferred embodiment, a heat dissipation wing extends rearward from an upper surface of the front frame, and wherein the front segment, the contact pins, and the front frame are structurally conforming to the USB standard or the IEEE 1394 standard.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE PREFERRED EMBODIMENT

Figure 1:
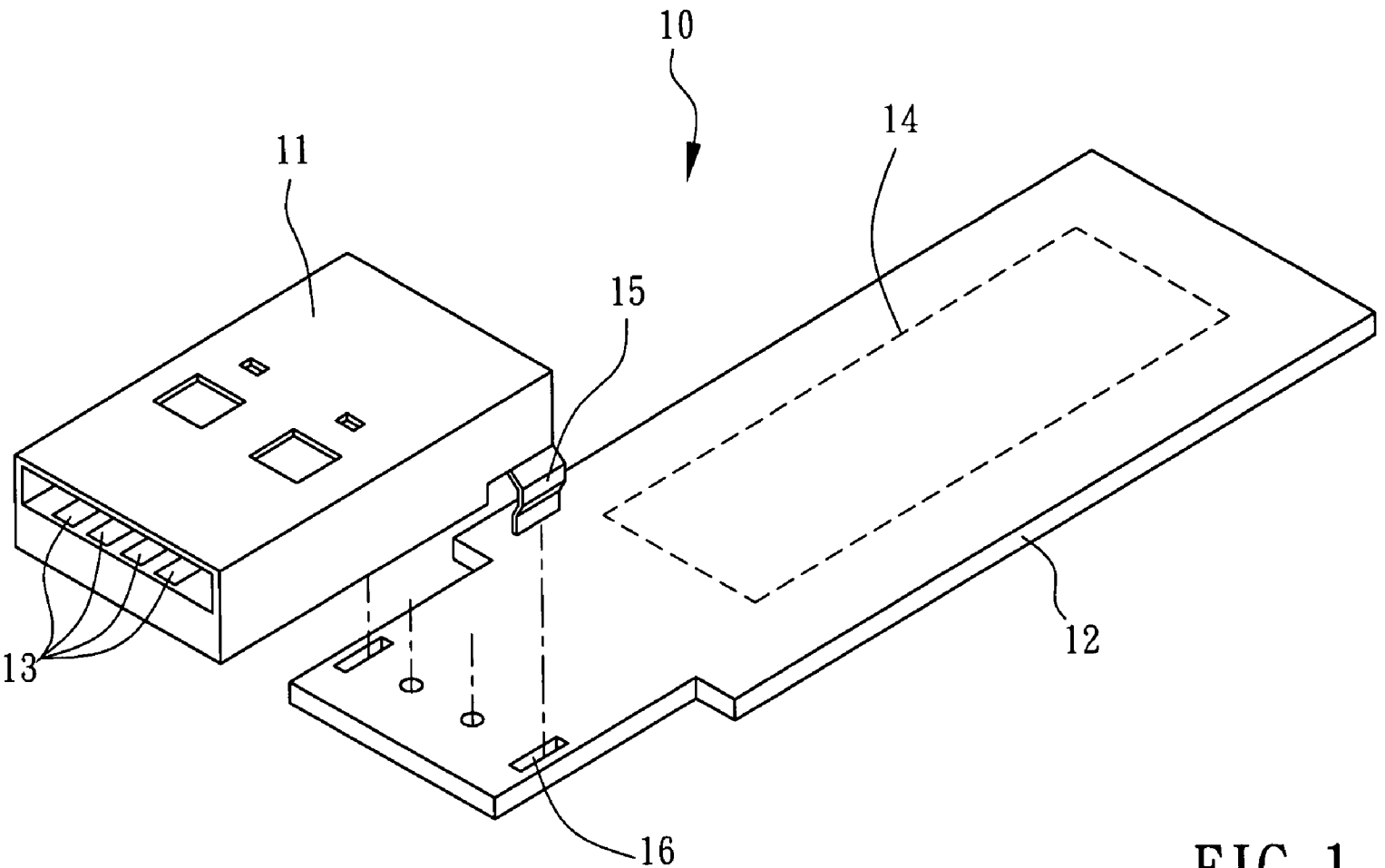
FIG. 1 (PRIOR ART)
FIG. 1 is a schematic drawing of a conventional USB connector.
Figure 2:
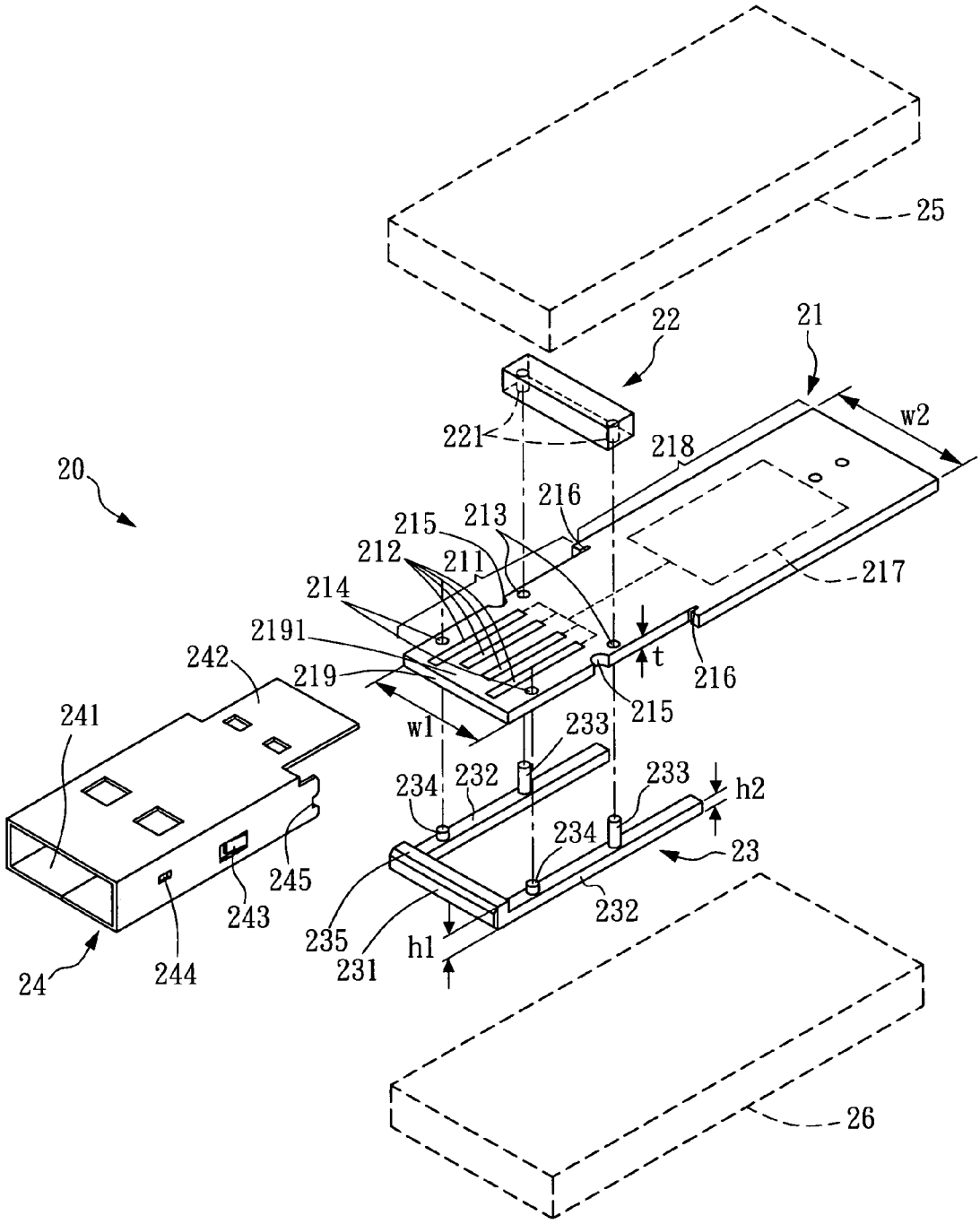
FIG. 2 is an exploded view of an electronic connector according to a preferred embodiment of the present invention.
Figure 3:
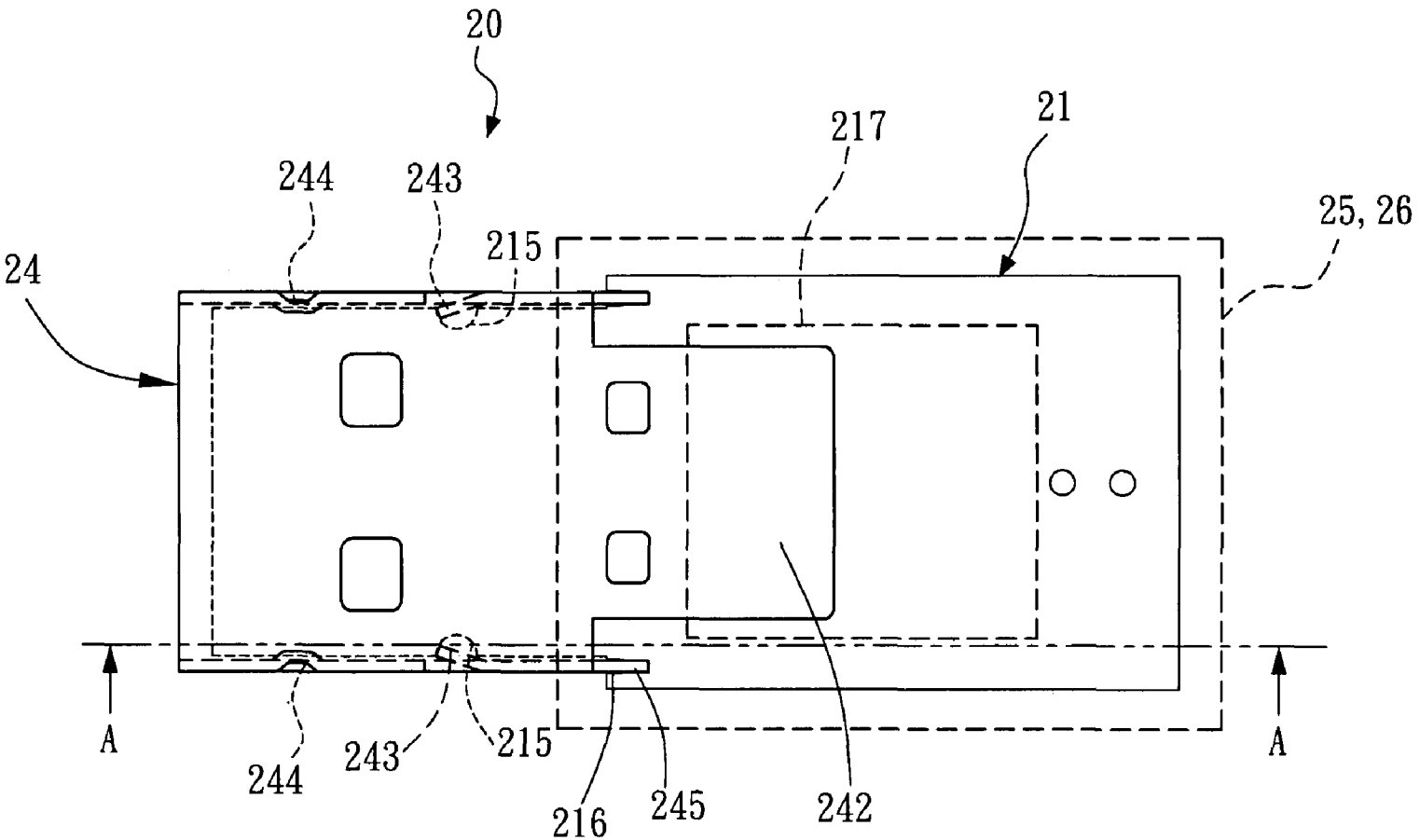
FIG. 3 is a top view of the electronic connector of FIG. 2.
Figure 4:
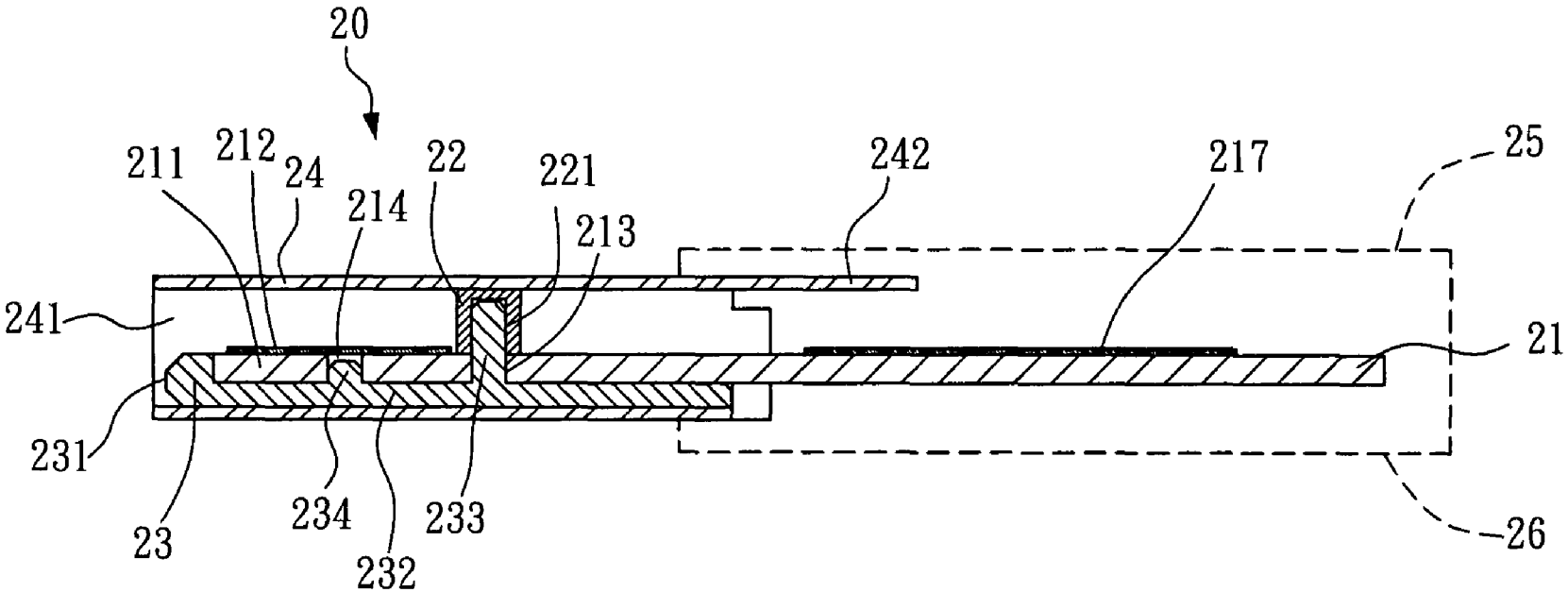
FIG. 4 is a sectional view of the electronic connector taken along Line A-A of FIG. 3.

FIGS. 2 through 4 provides an exploded view, a top view, and a sectional view of an electronic connector 20 according to one preferred embodiment of the present invention. The electronic connector 20 comprises a circuit board 21, an upper spacer 22, a lower spacer 23, a front frame 24, an upper housing 25, and a lower housing 26. For serving jointly to enclose the circuit board 21 for preventing a control unit and electronic elements thereon from being exposed outside, the upper and lower housings 25, 26, depicted by broken lines in the drawings, are known in the art and need not to be described in detail hereinto.

Referring to FIG. 2, the circuit board 21 is a lengthwise plate having a front segment 211 provided with a plurality of contact pins 212. Furthermore, at least one first positioning hole 213, at lest one second positioning hole 214, at least one first notch 215, at lest one second notch 216, and a control unit 217 are formed on the circuit board 21. In the shown embodiment, the front segment 211 has a width w1 slightly smaller than a width w2 of a rear segment 218 of the circuit board 21. The first positioning holes 213, the second positioning holes 214, the first notches 215, and the second notches 216 are provided in pairs. Therein, the first and second positioning holes 213, 214 are formed near two opposite edges of the front segment 211 of the circuit board 21. The two first notches 215 are formed at the two opposite edges of the front segment 211 of the circuit board 21 and extending transversely inward. The two second notches 216 formed at two opposite edges of the circuit board 21 around the border between the front segment 211 and the rear segment 218 extend lengthwise into the rear segment 218. The contact pins 212 and the front frame 24 have dimensions and configurations conforming to the USB standard or the IEEE 1394 standard. The circuit board 21 is preformed with circuit layouts for electrically connecting the contact pins 212 with the control unit 217. In the present embodiment, the control unit 217 is designed to support wireless network communication or a plug-and-play memory.

In the present embodiment, the upper and lower spacer 22, 23 are made of a non-conductive material, including, but not limited to, plastic and ceramics. The upper spacer 22 is arranged transversely on the circuit board 21 and corresponding to the two first positioning holes 213. Beside, in the present embodiment, two downward countersinks 221 are provided on the upper spacer 22 corresponding to the first positioning holes 213. The lower spacer 23 is designed to engage with the front segment 211 of the circuit board 21 from below. The lower spacer 23 structurally has a front bar 231 and two ribs 232 extending rearward from two ends of the front bar 231 for a predetermined length. The ribs 232 correspond to the two opposite lengthwise edges of the circuit board 21. Thereby, the lower spacer 23 is generally of a C-shaped structure, which effectively reduces the weight and material cost of the lower spacer 23. In the lower spacer 23, a post 233 is provided at atop each said rib 232 and corresponding to a respective said positioning hole 213 (also corresponding to a respective said countersink 221). Each of the posts 233 passes through the corresponding positioning hole 213 of the circuit board 21 from below and then gets received in the corresponding countersink 221, as shown in FIG. 4. Thereby, the circuit board 21 is sandwiched between the upper and lower spacers 22, 23. In addition, two protuberances 234 are provided on the ribs 232 of the lower spacer 23 and corresponding to the second positioning holes 214 so that the protuberances 234 can be inserted into the second positioning holes 214, thereby positioning the circuit board 21 with enhanced firmness. The front bar 231 abuts against a front edge 219 of the front segment 211 of the circuit board 21 from the front. The front bar 231 has a thickness h1 greater than a thickness h2 of each said rib 232 while a difference between the thicknesses of the front bar 231 and the rib 232 (h1−h2) is substantially equal to a thickness t of the front segment 211 of the circuit board 21. Consequently, when the lower spacer 23 is coupled to the front segment 211 of the circuit board 21 from below, an upper surface 235 of the front bar 231 is substantially level with an upper surface 2191 of the front segment 211 of the circuit board 21. The thickened front bar 231 that abuts against the front edge 219 of the front segment 211 of the circuit board 21 effectively protects the front edge 219 from being damaged during plugging or unplugging operation of the electronic connector, thereby improving the service life of the disclosed electronic connector 20.

The front frame 24 is a frame made of metal sheet through a punching process. The front frame 24 has a through opening 241 and is mounted around the front segment 211 of the circuit board 21 so that the front segment 211 and the upper and lower spacers 22, 23 are received in the through opening 241 of the front frame 24. Therein, the upper and lower spacers 22, 23 isolate the circuit board 21 from an inner surface of the front frame 24 so as to prevent electrical contact between the front frame 24 and the front segment 211 of the circuit board 21, thereby avoiding short circuit. A heat dissipation wing 242 extending rearward from an upper surface of the front frame 24 overhangs the control unit 217 of the circuit board 21 for facilitating heat dissipation. Two retainers 243 are formed on the front frame 24 for engaging with the first notches 215. The retainers 243 are formed as two inward-bent parts by partially punching the front frame 24 inward the through opening 241. The retainers 243 are designed to be coupled with the first notches 215, so as to prevent lengthwise displacement between the circuit board 21 and the front frame 24. Meantime, two depressed portions 244 are formed as two inward-bent parts by partially punching the front frame 24 inward the through opening 241. The two depressed portions 244 abut against the two edges of the front segment 211 of the circuit board 21, so as to prevent widthwise swing between the circuit board 21 and the front frame 24. Besides, two recesses 245 are formed on the front frame 24 and corresponding to the two second notches 216. The recesses 245 have a common opening direction perpendicular to that of the second notches 216, so that the two recesses 245 and the two second notches 216 can be crisscross coupled, thereby preventing relative rotation between the circuit board 21 and the front frame 24 in both directions. Moreover, upon joints between the recess 245 and the second notches 216, tin soldering may be applied to ensure firm combination of the circuit board 21 and the front frame 24. Therefore, the electronic connector 20 of the present invention uses the retainer 243, the depressed portions 244, and the recesses 245 to engage with the first notches 215, the opposite lengthwise edges, and the second notches 216 of the circuit board 21, thereby preventing relative displacement and swing between the circuit board 21 and the front frame 24 in any direction. As a result, the structural strength and firmness of the electronic connector 20 can be significantly improved.

To sum up, the electronic connector 20 of the present invention advantageously integrates the plural contact pins 212 in the connecting portion 11 and the control unit 217 that comprises numerous electronic elements onto a single circuit board 21. In addition, the electronic connector 20 of the present invention uses the upper and lower spacers 22, 23 to properly position the circuit board 21 in the through opening 241 of the front frame 24. Moreover, the electronic connector 20 of the present invention implements the engagement between the retainer 243, the depressed portions 244, and the recesses 245 of the front frame 24, and the first notches 215, the opposite lengthwise edges, and the second notches 216 of the circuit board 21 to prevent relative displacement and swing between the circuit board 21 and the front frame 24 in any directions. Thereby, the SMT process conventionally required for combining the connecting portion and the circuit board of the eclectic connector is no more required. Meantime, the disclosed electronic connector is economical and easy in manufacture and is compact in size.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An electronic connector, comprising:

a circuit board, which has a front segment provided with a plurality of contact pins, and has at least one first positioning hole formed at a predetermined location on the circuit board;

an upper spacer, which is positioned on the circuit board and is corresponding to the first positioning hole;

a lower spacer, which is coupled to the front segment of the circuit board from below, wherein at least one post is provided on the upper spacer or the lower spacer for corresponding to the first positioning hole so that when the post passes through the first positioning hole, the circuit board is sandwiched between the upper spacer and the lower spacer; and a front frame, which has a through opening and is mounted around the front segment of the circuit board, so that the front segment, the upper spacer, and the lower spacer are such received in the through opening that the upper spacer and the lower spacer are positioned between the circuit board and the front frame, thereby preventing the front frame from electrically connecting with the front segment of the circuit board.

2. The electronic connector of claim 1, wherein the upper spacer and the lower spacer are made of a non-conductive material, and the lower spacer comprises a front bar and two ribs extending from two ends of the front bar so that the lower spacer is generally of a C-shaped structure, wherein the at least one post includes two posts provided on the ribs of the lower spacer, respectively, and the upper spacer has two countersinks corresponding to the two posts, so that the posts of the lower spacer passing through the first positioning holes are received in the two countersinks of the upper spacer.

3. The electronic connector of claim 2, wherein the circuit board has at least one second positioning hole, and the lower spacer has at least one protuberance corresponding to the at least one second positioning hole, so that the protuberance is received in the second positioning hole.

4. The electronic connector of claim 2, wherein the front bar abuts against a front edge of the front segment of the circuit board, and the front bar has a thickness greater than a thickness of each said rib, wherein a difference between the thicknesses of the front bar and the ribs is generally equal to a thickness of the front segment of the circuit board, so that when the lower spacer is coupled below the front segment of the circuit board, an upper surface of the front bar is generally level with an upper surface of the front segment of the circuit board.

5. The electronic connector of claim 1, wherein at least one first notch is formed at one of two opposite lengthwise edges of the front segment of the circuit board and extending transversely inward while at least one retainer is formed on the front frame and corresponding to the first notch, so that the retainer engages with the first notch.

6. The electronic connector of claim 1, wherein at least one second notch is formed at one of two opposite lengthwise edges of the circuit board at a predetermined location while at least one recess is formed on the front frame and corresponding to the second notch, wherein the recess has an opening direction perpendicular to an opening direction of the second notch, so that the recess and the second notch are crisscross coupled.

7. The electronic connector of claim 1, wherein two depressed portions are formed as two inward-bent parts by partially punching the front frame inward, and the two depressed portions abut against two opposite lengthwise edges of the front segment of the circuit board at predetermined locations.

8. The electronic connector of claim 1, wherein a heat dissipation wing extends rearward from an upper surface of the front frame, and wherein the front segment, the contact pins, and the front frame are structurally conforming to the USB standard or the IEEE 1394 standard.

9. An electronic connector, comprising:

a circuit board, which has a control unit and at least one positioning hole, and has a front segment provided with a plurality of contact pins electrically connected with the control unit;

an upper spacer, which is made of a non-conductive material and is positioned on the circuit board;

a lower spacer, which is made of a non-conductive material and is coupled below the circuit board, so that the front segment of the circuit board is sandwiched between the upper spacer and the lower spacer; and a front frame, which has a through opening and is mounted around the front segment of the circuit board, so that the front segment, the upper spacer, and the lower spacer are such jointly received in the through opening that the upper spacer and the lower spacer are positioned between the circuit board and the front frame, thereby preventing the front frame electrically connecting with the front segment of the circuit board;

wherein, at least one post and at least one countersink are respectively provide on the upper spacer and the lower spacer corresponding to the least one first positioning hole, so that when the post passing through the first positioning hole is received in the countersink, the circuit board is sandwiched between the upper spacer and the lower space.

10. The electronic connector of claim 9, wherein the lower spacer comprises a front bar and two ribs extending from two ends of the front bar so that the lower spacer is generally of a C-shaped structure, wherein the at least one post includes two posts provided on the ribs of the lower spacer, respectively, and the upper spacer has two countersinks corresponding to the two posts, so that the posts of the lower spacer passing through the first positioning holes are received in the two countersinks of the upper spacer.

11. The electronic connector of claim 10, wherein the circuit board has at least one second positioning hole, and the lower spacer has at least one protuberance corresponding to the at least one second positioning hole, so that the protuberance is received in the second positioning hole.

12. The electronic connector of claim 10, wherein the front bar abuts against a front edge of the front segment of the circuit board, and the front bar has a thickness greater than a thickness of each said rib, wherein a difference between the thicknesses of the front bar and the ribs is generally equal to a thickness of the front segment of the circuit board, so that when the lower spacer is couple below the front segment of the circuit board, an upper surface of the front bar is generally level with an upper surface of the front segment of the circuit board.

13. The electronic connector of claim 9, wherein at least one first notch is formed at one of two opposite lengthwise edges of the front segment of the circuit board and extending transversely inward while at least one retainer is formed on the front frame and corresponding to the first notch, so that the retainer engages with the first notch.

14. The electronic connector of claim 9, wherein at least one second notch is formed at one of two opposite lengthwise edges of the circuit board at a predetermined location while at least one recess is formed on the front frame and corresponding to the second notch, wherein the recess has an opening direction perpendicular to an opening direction of the second notch, so that the recess and the second notch are crisscross coupled.

15. The electronic connector of claim 9, wherein two depressed portions are formed as two inward-bent parts by partially punching the front frame inward, and the two depressed portions abut against two opposite lengthwise edges of the front segment of the circuit board at predetermined locations.

16. The electronic connector of claim 9, wherein a heat dissipation wing extends rearward from an upper surface of the front frame, and wherein the front segment, the contact pins, and the front frame are structurally conforming to the USB standard or the IEEE 1394 standard.

* * * * *